US007383596B2

(12) United States Patent
James et al.

(10) Patent No.: US 7,383,596 B2
(45) Date of Patent: Jun. 10, 2008

(54) FOLDING MECHANISM FOR A FUTON SOFA SLEEPER

(75) Inventors: H. Keith James, Carl Junction, MO (US); Dennis E. Arft, Joplin, MO (US)

(73) Assignee: L & P Property Management Company, South Gate, CA (US)

( * ) Notice: Subject to any disclaimer, the term of this patent is extended or adjusted under 35 U.S.C. 154(b) by 0 days.

(21) Appl. No.: 11/532,924

(22) Filed: Sep. 19, 2006

(65) Prior Publication Data

US 2008/0066227 A1 Mar. 20, 2008

(51) Int. Cl.
*A47C 17/13* (2006.01)
*A47C 17/17* (2006.01)

(52) U.S. Cl. ..... 5/37.1; 5/41; 5/42.1; 5/55.1

(58) Field of Classification Search ..... 5/37.1, 5/41, 42.1, 17, 18, 55.1
See application file for complete search history.

(56) References Cited

U.S. PATENT DOCUMENTS 3,002,198 A * 10/1961 Kaiser, Jr. ..... 5/41
3,984,883 A 10/1976 Wong
4,016,611 A 4/1977 Harty
4,067,073 A 1/1978 Komarov
4,086,671 A 5/1978 Lane
4,205,405 A 6/1980 Hagney
4,402,096 A * 9/1983 Atimichuk ..... 5/17
4,442,556 A 4/1984 Craigie
4,538,308 A * 9/1985 Grigoriev ..... 5/42.1
4,571,755 A 2/1986 Stevens
4,586,206 A 5/1986 Singer
4,592,102 A 6/1986 Mizelle
4,608,722 A 9/1986 Zorzetto
4,628,551 A * 12/1986 Atimichuk ..... 5/12.1
4,694,515 A * 9/1987 Rogers, Jr. ..... 5/13
4,782,540 A 11/1988 Parker
5,107,558 A 4/1992 Luck
5,327,591 A 7/1994 Fireman et al.
6,006,383 A 12/1999 Pile et al.
6,098,223 A 8/2000 Larson (Continued)

FOREIGN PATENT DOCUMENTS

EP 0220582 5/1987

*Primary Examiner*—Michael Trettel
(74) *Attorney, Agent, or Firm*—Shook, Hardy & Bacon, L.L.P.

(57) ABSTRACT

This invention is directed to a futon sofa sleeper having a sofa frame, a folding mechanism and a mattress assembly. The a sofa frame has a back with a cavity and a pair of opposed arms. The folding mechanism folds into and out of the sofa frame and is extendable from a first position to a second position. The folding mechanism includes a frame with a rear section rotatably coupled with the sofa frame, a middle section pivotally coupled with the rear section, and a front section pivotally coupled with the middle section. The mattress assembly is supported on the folding mechanism and contains a shell and an inner support received within the shell. The inner support including an innerspring construction and an air bladder, wherein in the first position, the rear and middle sections of the folding mechanism are located within the cavity and the front section is used as a seating surface and wherein in the second position, the rear, middle, and front sections are used as a sleeping surface.

17 Claims, 7 Drawing Sheets

U.S. PATENT DOCUMENTS 6,161,231 A * 12/2000 Kraft et al. ..... 5/18.1
6,463,610 B1 10/2002 Shulte et al.
6,665,893 B2 * 12/2003 Fruge ..... 5/12.1
6,668,395 B1 12/2003 Chen
6,745,420 B2 6/2004 Giori et al.
6,763,540 B1 7/2004 Wang
6,857,142 B2 2/2005 Fruge
6,904,628 B2 6/2005 Murphy et al.
2002/0133883 A1 9/2002 Perez et al.
2003/0135930 A1 7/2003 Varese et al.
2004/0010855 A1 1/2004 Piraino
2004/0073999 A1 4/2004 Fruge
2004/0074008 A1 4/2004 Martens et al.
2004/0139551 A1 7/2004 Wang

* cited by examiner

FOLDING MECHANISM FOR A FUTON SOFA SLEEPER

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

This invention relates generally to a folding mechanism for a sofa sleeper and, more particularly, to a folding mechanism for a futon type sofa sleeper having a mattress that contains both an innerspring construction and an air bladder, whereby the air bladder may be deflated for easy storage of the mattress within the futon sofa sleeper.

Traditional futon sofa sleepers are designed to be used as both a sofa and a bed. The futon sofa sleepers are designed with a folding frame mechanism that allows the futon mattress to be used as the support for the user when the unit is used as a sofa as well as a bed. Specifically, the futon mattress rests upon a support surface and the support surface can be moved from a sofa configuration to a sleeping configuration. The mattress supports the user in both the seated position and the sleep position. The mattress is typically foldable and includes an outer shell and an inner material. Due to the necessity of the mattress to fold, the inner material is typically a bedding material, including but not limited to, foam, feathers, cotton stuffing, and the like. Thus, while the mattress may be folded, the composition of the inner material does not provide a sleeping or sitting surface that is as comfortable as a typical sofa sleeper. Further, standard futon sofa sleepers typically sit low to the floor. As such, the futon sofa sleeper, when in the sofa configuration, is very low and not as comfortable to the seated user as a typical sofa.

Thus, it would be desirable to manufacture a futon sofa sleeper that provides the enhanced comfort and the look of a conventional sofa sleeper for the individual sleeping or sitting thereon.

BRIEF SUMMARY OF THE INVENTION

This invention is directed to a futon sofa sleeper having the appearance of a conventional sofa. The sofa sleeper contains a sofa frame, a folding mechanism, and a mattress. The folding mechanism is coupled to the sofa frame by a mounting frame. The folding mechanism is movable between a stowed, sofa position and a deployed, sleeper position. The sofa frame includes a pair of sides and a back with a cavity. The folding mechanism contains a frame with rear, middle and front sections. The cavity houses the rear and middle sections of the frame when the frame is in the sofa position. The rear section is rotatably coupled to the section and the middle section is rotatably coupled with the front section. Coupling is achieved via hinges. Each of the portions of the folding mechanism contain a support surface. The support surfaces are used to support the mattress.

The mattress contains a shell and an inner support. The shell includes a lower panel, a sidewall portion, and a cover. The lower panel, sidewall portion, and cover fit together to form a cavity to receive the inner support. The inner support includes both an innerspring portion and an air bladder portion. The air bladder portion has a valve apparatus, which is adapted to selectively allow air into and out of the air bladder.

The air bladder and innerspring portions are configured to provide the support of a conventional mattress while also allowing for easy folding during storage. This is accomplished due to the fact that the air bladder may be deflated when not in use. The air bladder portion once deflated is relatively thin thereby resulting in a compact configuration that fits within the cavity in the back of the sofa frame. Moreover, the location of the spring portion when in the stowed, sofa configuration allows the futon sofa sleeper to have the feel of a conventional sofa for a person sitting thereon. Thus, the inherent nature of the folded mattress when stored and the positioning of the innerspring portion, provides a seating surface that retains the form and fit of a conventional sofa.

BRIEF DESCRIPTION OF THE SEVERAL VIEWS OF THE DRAWING

These and other objectives and advantages of the present invention will be more readily apparent from the following detailed description of the drawings of the preferred embodiment of the invention that are herein incorporated by reference and in which.

DETAILED DESCRIPTION OF THE INVENTION

Figure 1:
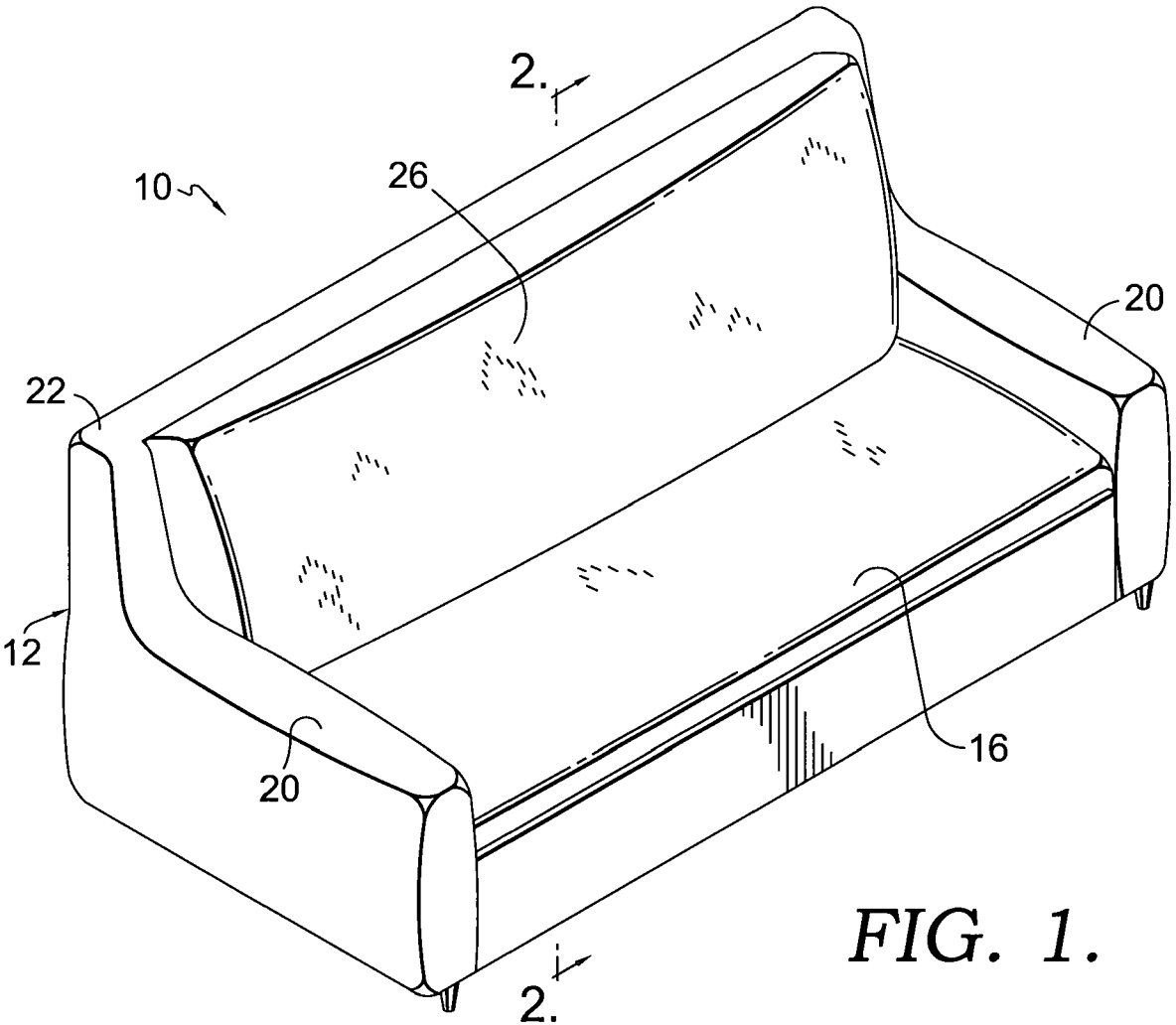
FIG. 1 is a perspective view a futon sofa sleeper in a stowed, sofa position according to the present invention.
Figure 2:
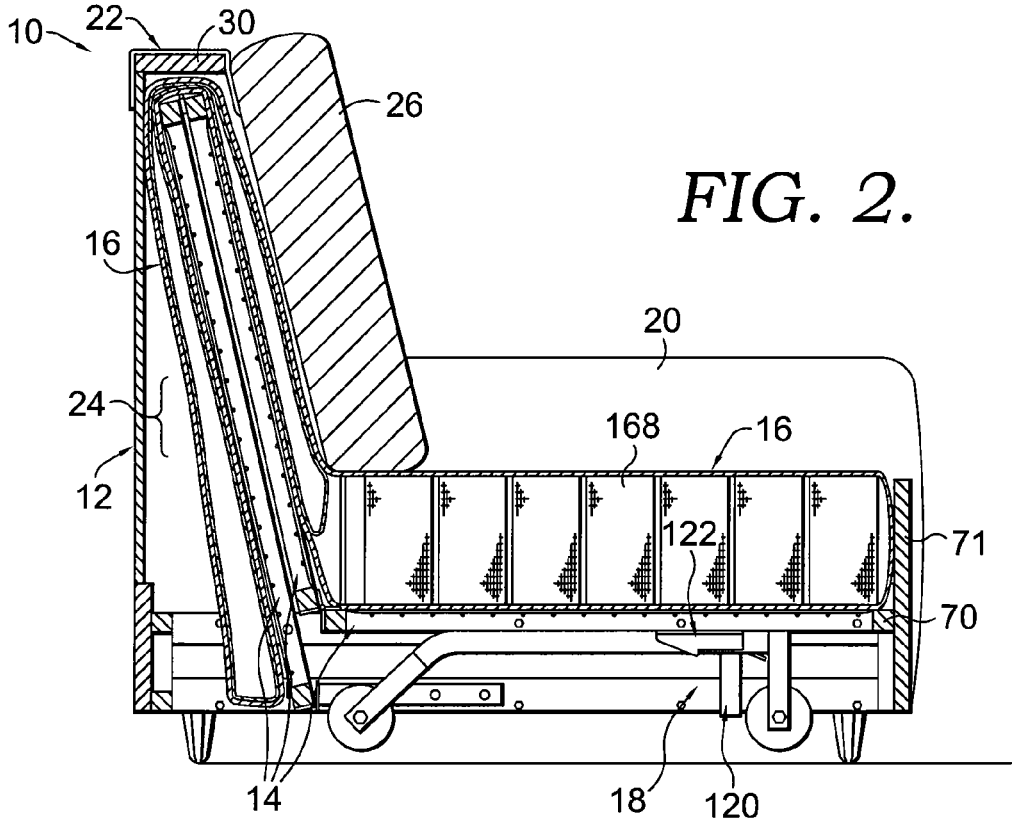
FIG. 2 is a cross-sectional view of the futon sofa sleeper of FIG. 1 in the stowed, sofa position, taken along the line 2-2.
Figure 3:
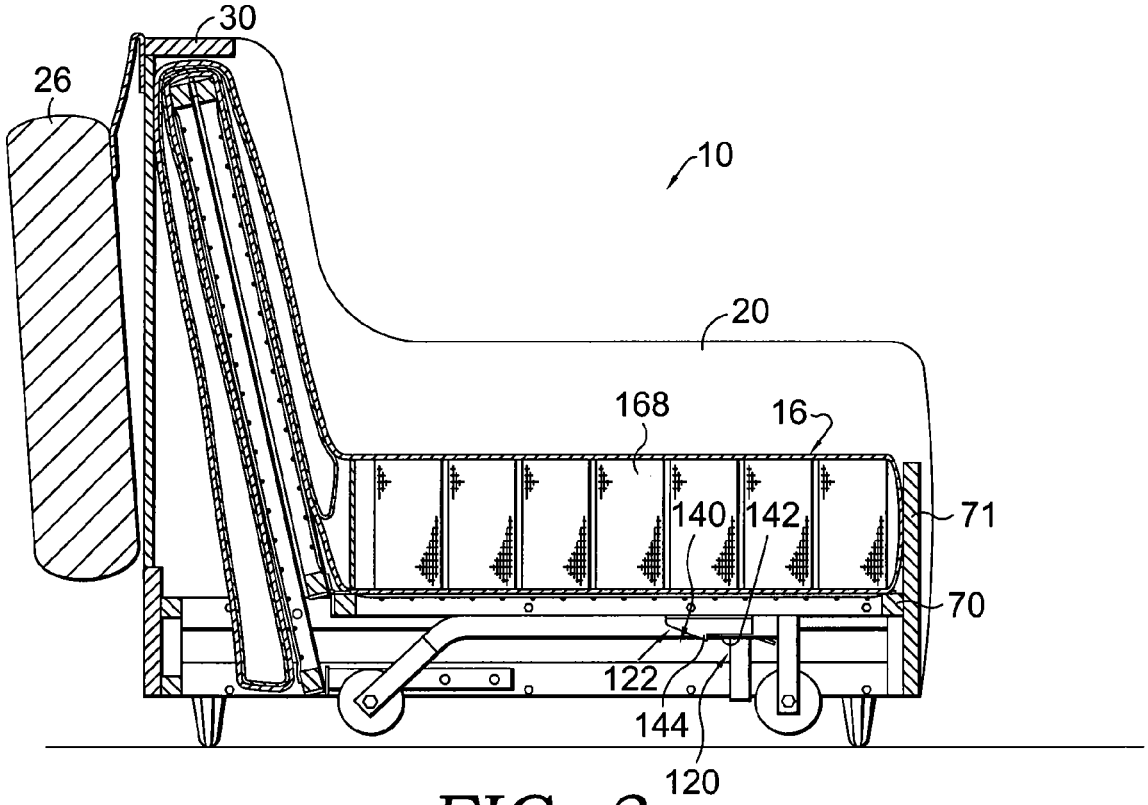
FIG. 3 is a view similar to FIG. 2, with the futon sofa sleeper in the stowed, sofa position and the back cushion rotated upwardly and over the back.
Figure 4:
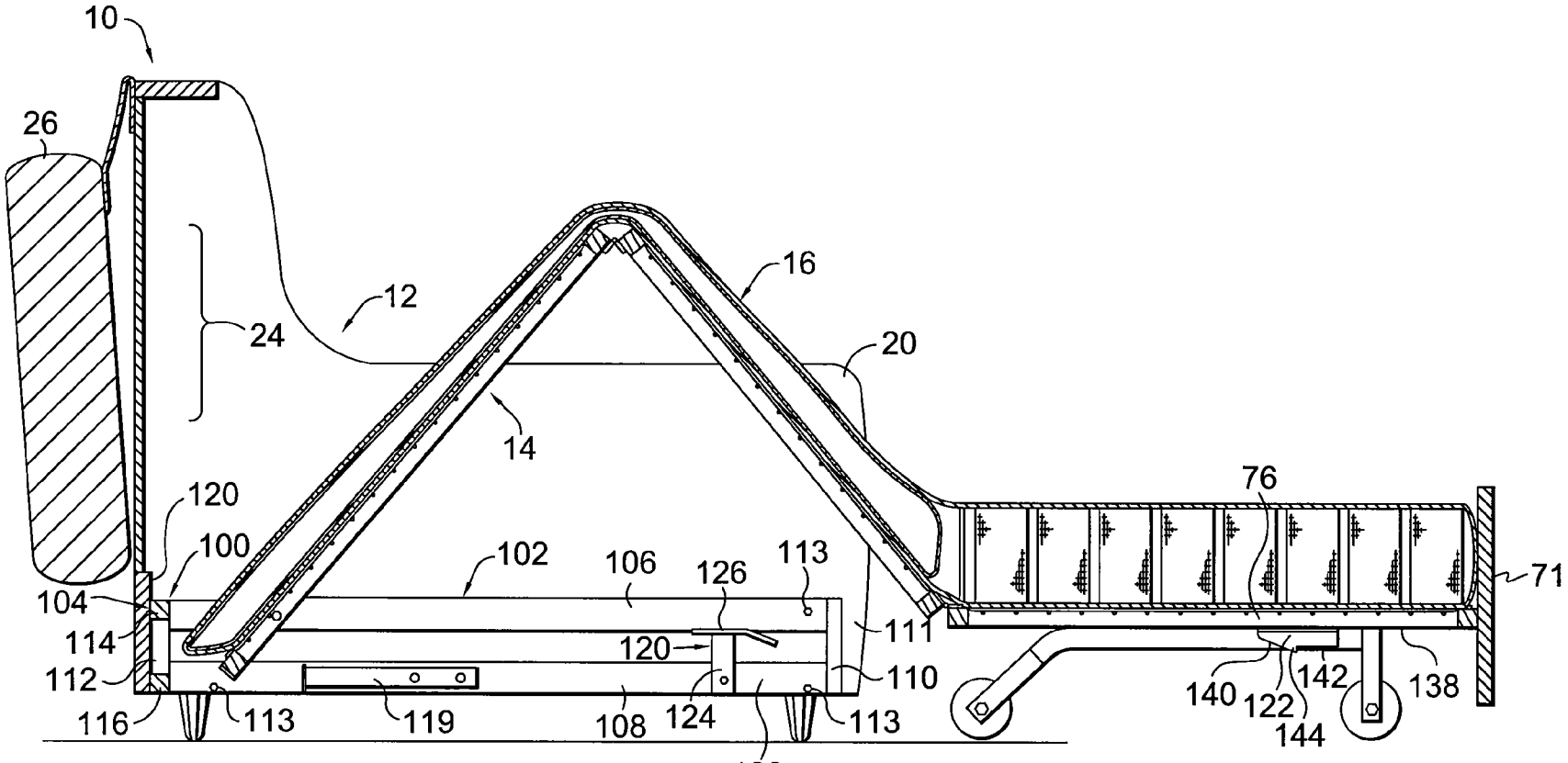
FIG. 4 is a view similar to FIG. 3, but with the futon sofa sleeper in an intermediate, folded position and the air bladder portion of the mattress being deflated.

With initial reference to FIGS. 1-3, a sofa sleeper according to the principles of the present invention is designated generally with the reference numeral 10. Throughout this specification, the term sofa sleeper 10 is also intended to encompass love seats and other smaller units. The sofa sleeper 10 can be converted from a stowed, sofa position, shown in FIGS. 1-3 to a deployed, sleeper position, shown in FIG. 5. As shown in FIGS. 1 and 2, the sofa sleeper 10 includes a sofa frame 12, a folding mechanism 14, a mattress 16, and a lock assembly 18. The sofa frame 12 includes a pair of arms 20 and a back 22. Both the arms 20 and the back 22 are upholstered in a traditional manner. As shown in FIGS. 2, 4, and 6, the back 22 contains a cavity 24 that houses a portion of the folding mechanism 14 and mattress 16 when the sofa sleeper is in the sofa configuration. As seen in FIGS. 1-3, the sofa sleeper 10, when in the stowed, sofa configuration, contains a back and cushion 26 that supports the user when seated. Further, the mattress 16 also supports the user when seated, as will be further discussed below. The back cushion 26 may be coupled to an upper surface 30 of the back 22 or may be a loose cushion design. As such, the back cushion 26 can be rotated upwardly and out of the way when the futon sofa sleeper 10 is converted from stowed, sofa position to the deployed, sleeper position.

Figure 8:
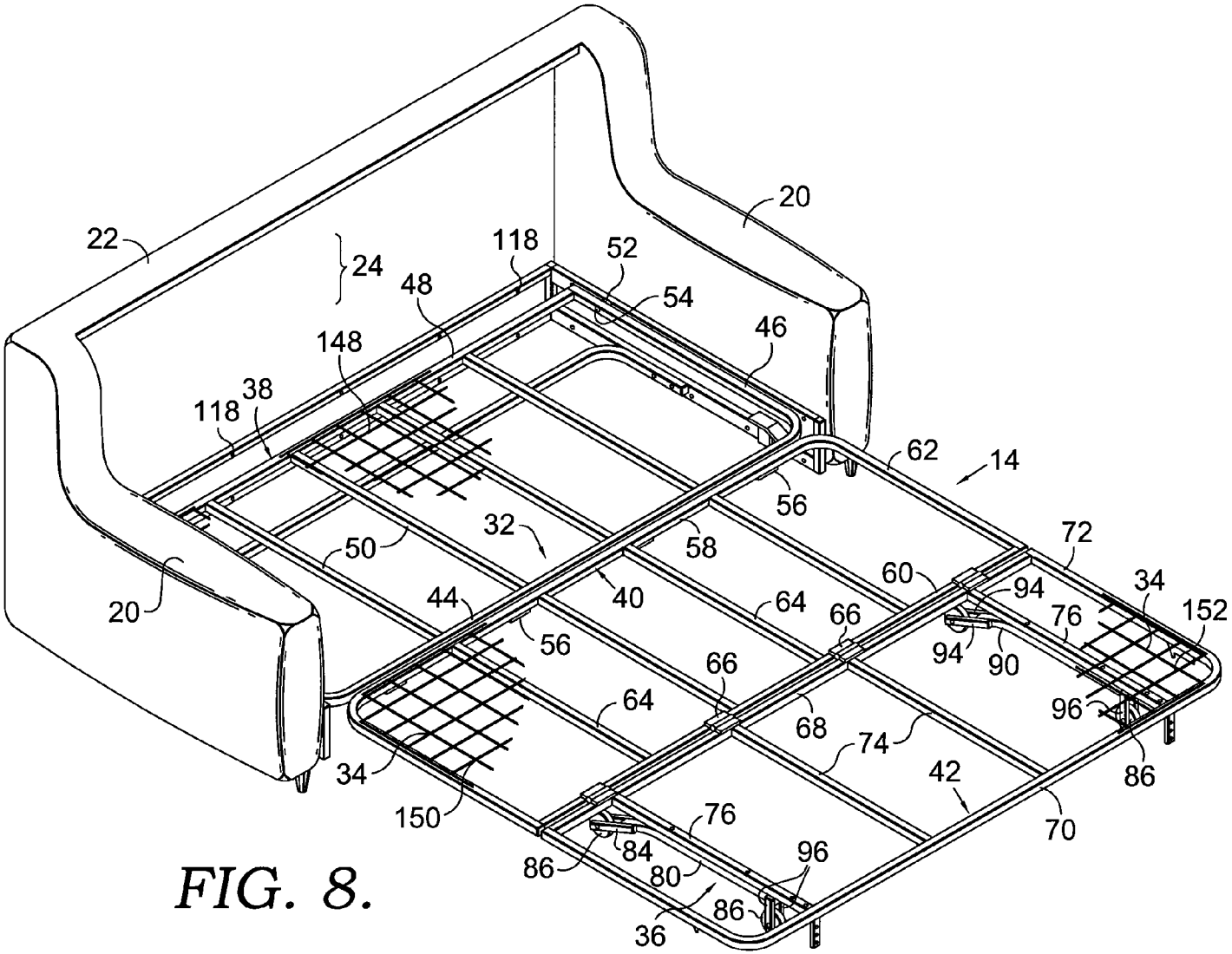
FIG. 8 is a perspective view of the futon sofa sleeper of FIG. 5 with the mattress removed.

Referring now to FIG. 8, the folding mechanism will be discussed. The folding mechanism 14 is coupled to the arms 20 of the sofa frame 12 and unfolds from within the cavity 24. The folding mechanism 14 includes a frame 32, a support surface 34, and a pair rolling supports 36. The frame 32 includes a rear section 38, a middle section 40, and a front section 42. The frame 32 is constructed from steel tubing and is shaped as shown. It will be appreciated by one of ordinary skill in the art that any suitable material may be used.

The rear section 38 includes front, side, and rear portions 44, 46, 48. The front, side, and rear portions 44, 46, 48 can be separate pieces or can be an integral unit. As shown here, the front portion 44 and side portions 46 are integral and the rear portion 48 is coupled to the sides portions 46. The rear section 38 further includes a plurality of cross members 50 that are coupled between the front and rear portions 44, 46 and are spaced apart to provide support. The side portions 46 of the rear section 38 are rotatably coupled to the arms 20 of the sofa sleeper 10. Coupling occurs via a nut and bolt arrangement 52 and apertures 54 in both the side portions 46 of the rear section 38 as will be discussed further below. However, it should be understood that any suitable coupling method may be used. The rear section 38 is coupled to the middle section 40 by a plurality of hinges 56. Specifically, the front portion 44 of the rear section 38 is coupled with a rear portion 58 of the middle section 40.

The middle section 40 includes front 60, side 62, and rear portions 58. The front, side, and rear portions 60, 62, 58 can be separate pieces or can be an integral unit. As shown here, the rear portion 58 and side portions 62 are integral and the front portion 60 is coupled to the side portions 62. The middle section 40 further includes a plurality of cross members 64 that are coupled between the front and rear portions 60, 58 and are spaced apart to provide support. As seen in FIGS. 7 and 8 the cross members 64 of the rear and middle sections 38, 40 are aligned with one another. The middle section 40 is coupled to the front section 42 by a plurality of hinges 66. Specifically, the front portion 60 of the middle section 40 is coupled with a rear portion 68 of the front section 42.

The front section 42 includes a front, side, and rear portions 70, 72, 68. The front, side, and rear portions 70, 72, 68 can be separate pieces or can be an integral unit. As shown here, the front portion 70 and side portions 72 are integral and the rear portion 68 is coupled to the side portions 72. The front section 42 further includes a pair of inner cross members 74 and a pair of outer cross members 76 that are coupled between the front and rear portions 70, 68 and are spaced apart to provide support. The front section 42 further includes a front foot portion 71 that is coupled to the front portion 70 and extends between the arms 20.

Figure 5:
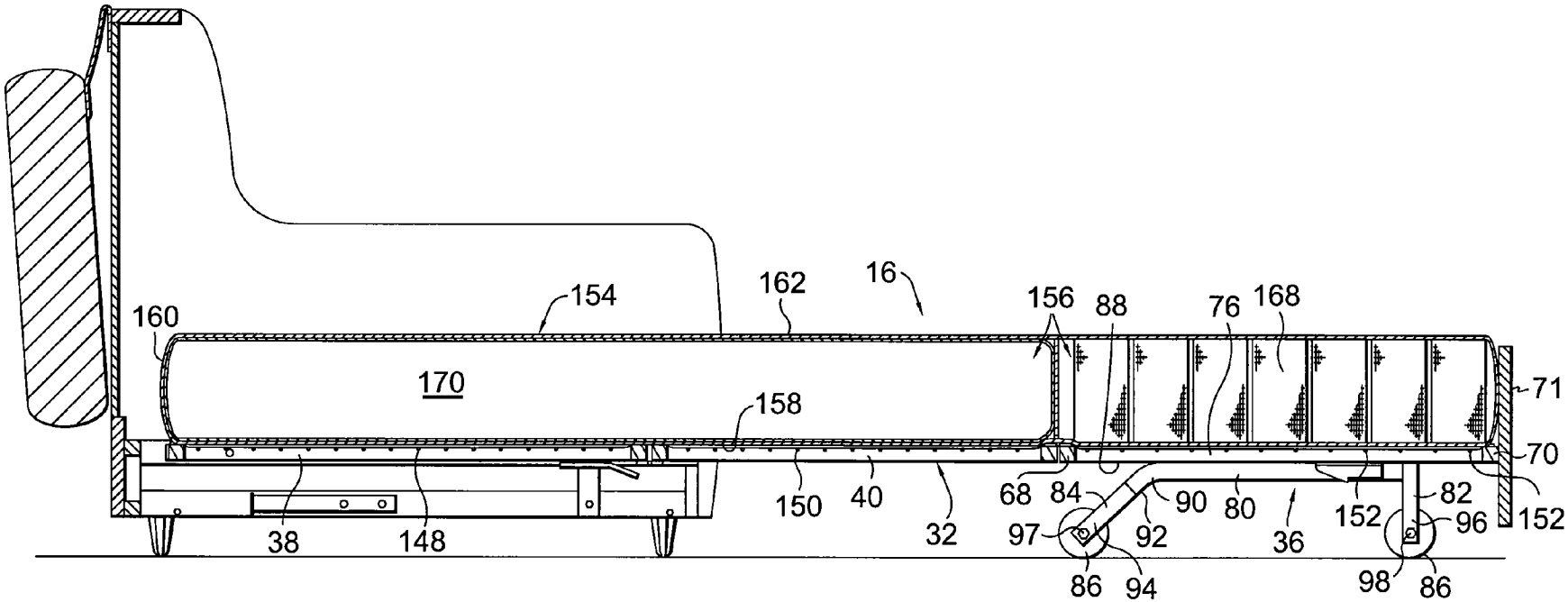
FIG. 5 is a view similar to FIG. 4, but with the futon sofa sleeper in a deployed, sleeper position and the air bladder portion of the mattress being inflated.
Figures 6, 7:
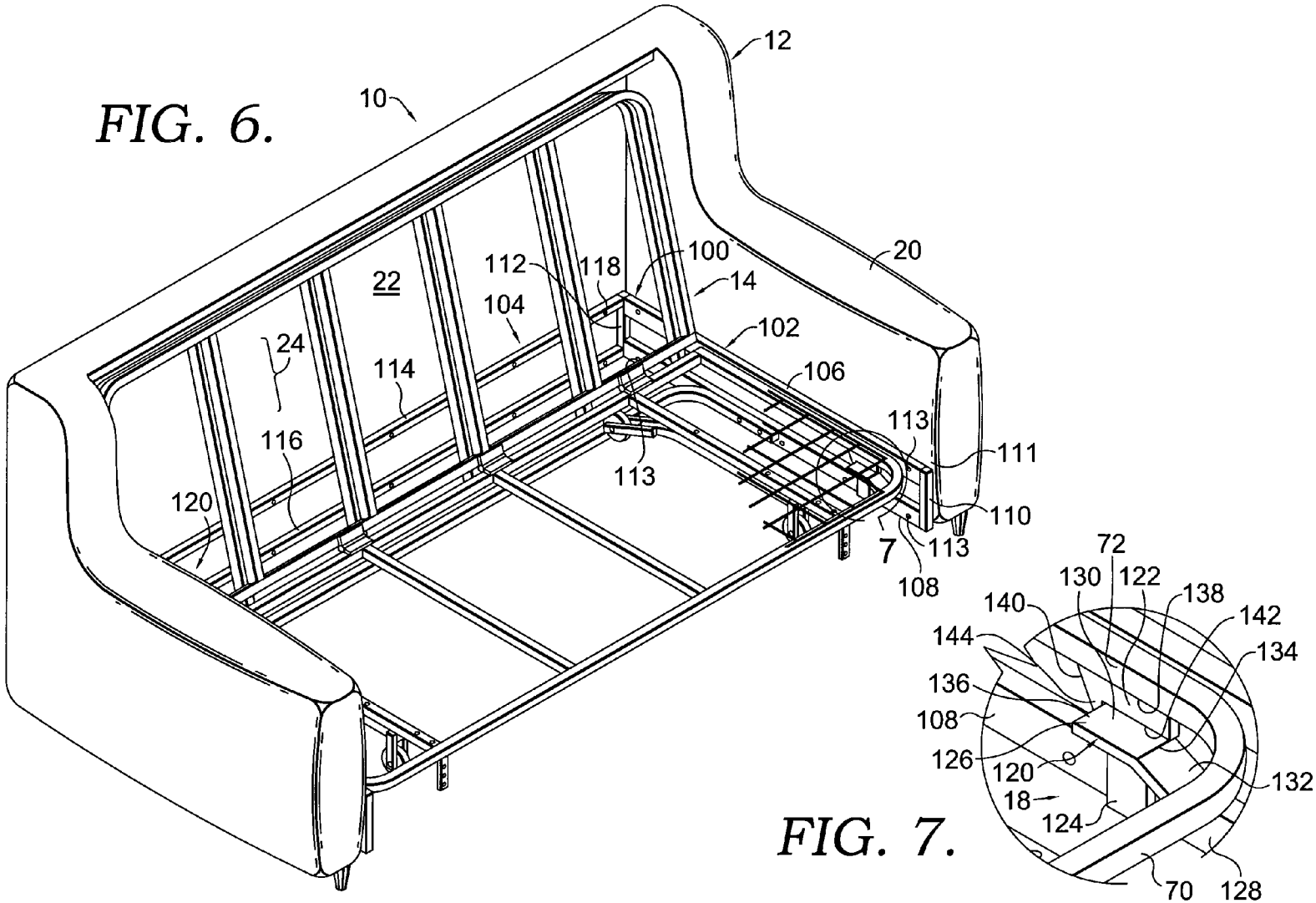
FIG. 6 is a perspective view of the futon sofa sleeper of FIG. 3 with the mattress removed.
FIG. 7 is an enlarged portion of FIG. 6 showing a lock assembly.

As seen in FIGS. 5 and 8 the folding mechanism further includes the pair of rolling supports 36. The rolling supports 36 are coupled to each of the outer cross members 76 via a nut and bolt arrangement, not shown. Each rolling support 78 includes an arm 80, a front fork 82, a rear fork 84, and a pair of wheels 86. The arm 80 is coupled with a lower surface 88 of the outer cross members 76. The arm 80 is shaped as shown and contains a downward bend 90 proximate the rear portion 68 of the front section 42. The arm 80 also contains an end 92 with the rear fork 84 attached thereto. The rear fork 84 contains a pair of legs 94 with the wheel 86 coupled therebetween. Each of the legs 94 contain an aperture 97 for attaching the wheel 86. The front fork 82 is mounted vertically near the front portion 70 of the front section 42 and abuts the arm 80. The front fork 82 depends downwardly from the lower surface 88 of the outer cross members 76. The front fork 82 contains a pair of legs 96 with the wheel 86 coupled therebetween. Each of the legs 98 contain an aperture 96 for attaching the wheel 86.

As seen in FIGS. 4 and 6, the folding mechanism 14 is coupled to the arms 20 of the sofa frame 12 by a mounting frame 100. The mounting frame 100 includes a pair of side portions 102 and a back portion 104. The side portions 102 include upper, lower, front, and rear members 106, 108, 110, 112 that are coupled to the arms 20 of the sofa frame 12 via a plurality of screws 113. It should be understood that any suitable coupling method may be used. The upper and lower members 106, 108 run parallel to one another along a lower portion 111 of the arms 20 of the sofa frame 12. The front and rear members 110, 112 interconnect the upper and lower members 106, 108. The back portion 104 includes upper and lower members 114, 116 that are coupled to the back 22 via a plurality of screws 118. The upper and lower members 114, 116 of the back portion 104 run parallel to one another along a lower portion 120 of the back 22 of the sofa frame 12. The upper and lower members 114, 116 are coupled to the rear members 112 of the side portions 102. A support bracket 119 is coupled between the lower members 108 of the mounting frame.

Referring now to FIGS. 3, 4 and 7, the lock assembly 18 will be discussed. The lock assembly 18 includes a pair of brackets 120 and a pair of latches 122. The brackets 120 each contain a leg 124 and a riser 126. The leg 124 of each lock assembly 18 is coupled to a front portion 128 of the lower member 108 of the side portion 106 of the mounting frame 100. The legs 124 are oriented vertically. The riser 126 contains an upper portion 130 and a ramp 132. The upper portion 130 contains a front 134 and a rear 136 and is oriented generally horizontally. The ramp 132 depends downwardly at an angle from the front 134 of the upper portion 130, the purpose of which will be discussed further below.

The latches 122 are coupled to an underside 138 of the side portions 72 of the front section 42 intermediate the front and rear portions 70,68. The latches 122 depend downwardly from the side portions 72. The latch 122 is shaped as shown and contains a mating surface 140 and a rest surface 142. The mating surface 140 is an angled surface that contacts the ramp 132 of the riser 126 when the futon sofa 10 is moved from the deployed, sleeper position to the stowed, sofa position. The rest surface 142 is a horizontal surface and a portion of the mating surface 140 projects above the rest surface 142 to create a stop 144. The stop 144 locks the folding mechanism 14 in place when the futon sofa 10 is moved from the deployed, sleeper position to the stowed, sofa position. Specifically, the stop 144 contacts the rear 136 of the upper portion 130 of the riser 126 as will be further discussed below.

Turning now to FIGS. 5 and 8, the support surface 34 will be discussed. The support surface 34 contains a rear portion 148, a middle portion 150, and a front portion 152. Each of the rear, middle, and front portions 148, 150, 152 are constructed of a wire grid that is coupled to the rear, middle, and front sections 38, 40, 42 of the frame 32. Coupling occurs via weldment, however, it should be understood that any suitable coupling method may be used.

Figure 9:
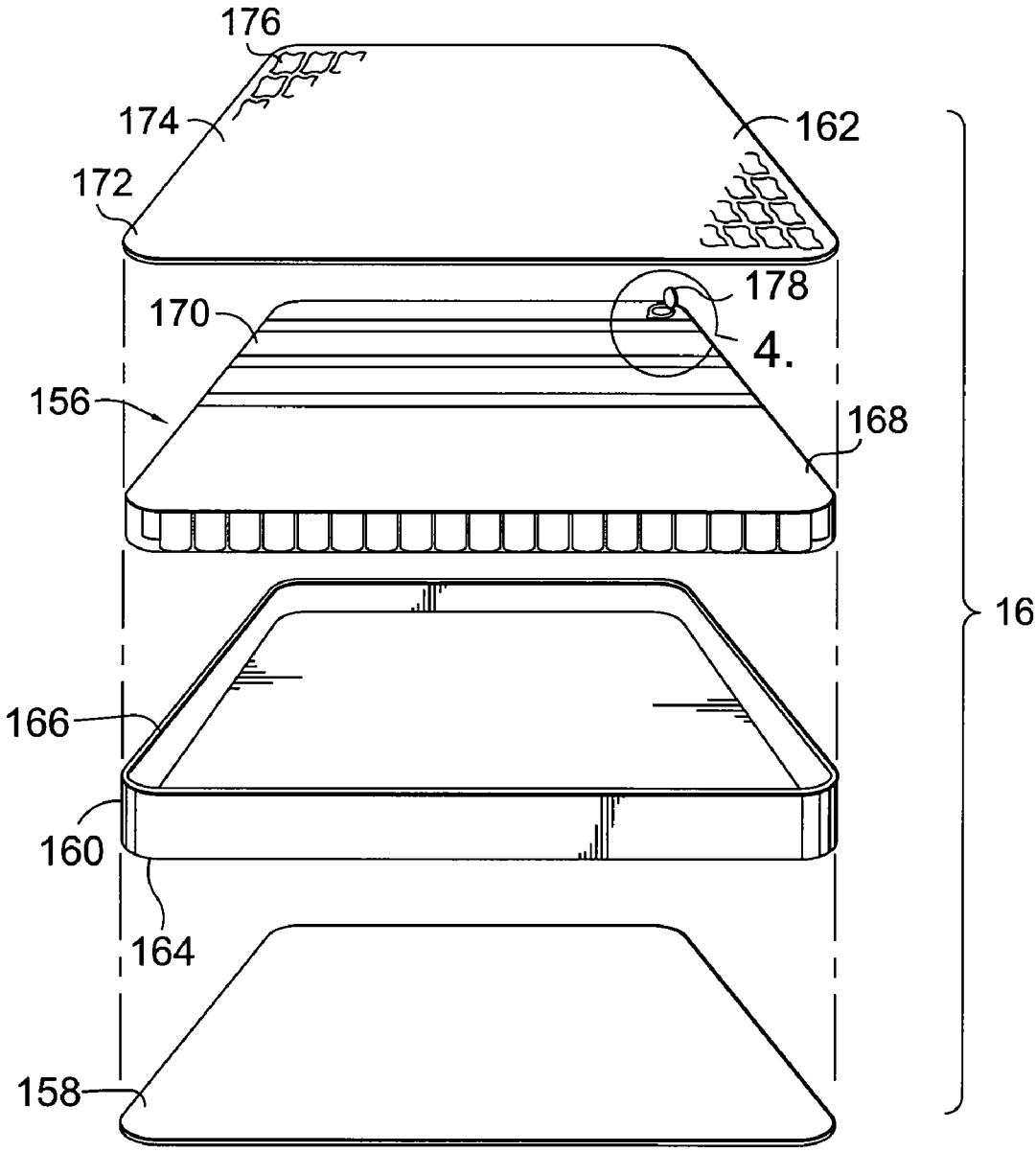
FIG. 9 is an front, exploded, perspective view of the mattress.

As best seen in FIGS. 5 and 8, the mattress 16 rests upon the support surface 34 of the frame 32 of the folding mechanism 14. Referring now to FIGS. 5 and 9, the mattress 16 includes a shell 154 and an inner support 156. The shell 154 includes a lower panel 158, a sidewall 160, and a cover 162. The lower panel 158 rests on the support surface 34. The sidewall 160 contains a lower edge 164 and an upper edge 166. The sidewall 160 is attached on its lower edge 164 to the lower panel 158 and extends around its perimeter. The cover 162 is attached to the upper edge 166 of the sidewall 160. As is understood by one of ordinary skill in the art, the shell 154 consisting of the lower panel 158, the sidewall 160, and the cover 162 fit together to form a cavity 168 to receive the inner support 156. Further, it will be appreciated by one of ordinary skill in the art that any attachment method for the cover could be used, such as a zipper, stitching, sewing or the like. In one embodiment, the sidewall has a zipper, not shown, attached on its upper edge 166 that is used to removably couple the cover 162 to the sidewall 160. This embodiment provides a cover 162 that is removably attached so that the user has direct access to the inner support 156. In another embodiment, the cover 162 is attached to the upper edge 166 of the sidewall 160 by stitching or sewing. This embodiment provides a permanent enclosure where the user will not have direct access to the inner support.

With continued reference to FIGS. 5 and 9, the inner support 156 is shown received within the shell 154. The inner support 156 broadly includes an innerspring portion 168 and an air bladder portion 170, both portions having a height comparable to a conventional sofa mattress 16. As is apparent to one of ordinary skill in the art, the mattress 16 further contains a foot end 172, a middle section 174, and a head end 176. The innerspring portion 168 is generally located at the foot end 172 of the mattress 16 while the air bladder portion 170 is located at the middle section 174 and head end 176. The air bladder 170 portion is sized to correspond to middle section 174 and head end 176 of the mattress 16 such that when the mattress 16 is folded for storage, the air bladder portion along with the rear and middle sections 38, 40 of the frame 32 fit within the cavity 24 in the back 22. As best seen in FIG. 5, the innerspring portion 168 abuts the air bladder portion 170 to form a continuous support surface for the user when the mattress 16 is in the deployed position. The innerspring portion 168 of the mattress 16 is any one of a number of existing innerspring configurations available and known to one of ordinary skill in the art. As an example, innerspring portion can be a pocketed coil.

The air bladder portion 170 is preferably made from a durable, air impermeable material, such as vinyl. The air bladder 170 may be one of a number of existing bladders currently available and known to one of ordinary skill in the art. The air bladder 170 includes a valve 178 that is integrally formed therein. The valve 178 is sized to accommodate an inflating pump, not shown that may be either external or internal to the bladder. In either configuration, the pump can contain a reversible deflation feature and/or a dump valve release system. Both the valve 178 and the pump are also conventional items known to one of ordinary skill in the art. Further, while the valve 178 is shown in FIG. 9 in the upper corner, the placement of the valve is not material to the discussion. It will be appreciated by one of ordinary skill in the art that the valve 178 may be located in the air bladder when the cover is removably attached with a zipper, as discussed above. This embodiment would provide access to the valve by opening the zipper. Additionally, it is also understood that the valve may extend through the shell for outside access if the cover and, thus, the shell are permanently sealed.

The operation of the sofa sleeper 10 will now be discussed. FIG. 5 illustrates the sofa sleeper 10 in the deployed, sleep position, wherein the mattress 16 is useful as a sleeping surface. The air bladder portion 170 of the mattress 16 is inflated and the air bladder portion 170 and the innerspring portion 168 abut to provide a continuous support surface for the user. FIG. 4 illustrates the sofa sleeper 10 in the intermediate, folded position, wherein the mattress 20 is ready to be stored. The air bladder portion 170 of the mattress 16 is deflated. From this position, the frame 14 is pushed inwardly to fully stow the mattress 16. In the stowed, sofa position, shown in FIGS. 2 and 3, the stop 144 of the latch 122 is engaged with the rear 136 of the riser 126, see FIG. 7. Further, the innerspring portion 168 of the mattress 16 provides a support for the seated user on the sofa sleeper 10. Because the innerspring portion 168 is shaped and sized similarly to the support portion of a traditional sofa, the innerspring portion 168 provides a support closely resembling the feel of a traditional sofa.

Referring again to FIGS. 2 and 3, to place the sofa sleeper 10 in a position for sleeping, the back cushion 26 is rotated upwardly and over the back 22. The front foot portion 71 of the front section 42 of the frame is pulled upwardly so that the stop 144 may disengage from the rear 136 of the riser 126. Once the stop 144 is disengaged, the folding mechanism 14 is pulled from within the sofa sleeper to the position shown in FIG. 4. It should be understood that the frame 32 unfolds as the user pulls on the front foot portion 71. Specifically, the rear and middle sections 38, 40 are pulled from within the cavity 24 in the back 22 of the sofa sleeper. In this position the air bladder portion 170 is deflated. The rear section 38 rotates in a clockwise manner about the nut and bolt connection 52 between the mounting frame 100 and the side portion 46. The sofa 10 is now in the deployed position as shown in FIG. 5. While FIG. 5 shows the air bladder portion 170 inflated, it should be understood that when the mattress 16 and folding mechanism 14 are pulled from within the sofa sleeper 10, the air bladder portion 170 is deflated.

The description that follows takes into account an inner support that is enclosed by a shell with a removable cover as described above. Referring now to FIG. 9, the zipper, not shown, is used to expose the valve 178 as is understood by one of ordinary skill in the art. The pump, not shown, is engaged with the valve 178 and the air bladder portion 170 is inflated. When the air bladder portion 170 is fully inflated the pump is disengaged and the cover 162 is then re-zipped to hide the valve 178. The sofa sleeper 10 in this position is ready for sleeping.

When the mattress 16 is to be stowed within sofa sleeper 10, the zipper, not shown, is used to expose the valve 178. The valve 178 is then opened, allowing air to escape from the bladder 170. Once the air is removed from the bladder 170, the cover 162 is then re-zipped.

The present invention has been described in relation to particular embodiments, which are intended in all respects to be illustrative rather than restrictive. Alternative embodiments will become apparent to those skilled in the art to which the present invention pertains without departing from its scope.

From the foregoing, it will be seen that this invention is one well adapted to attain all the ends and objects set forth above, together with other advantages which are obvious and inherent to the system and method. It will be understood that certain features and sub-combinations are of utility and may be employed without reference to other features and sub-combinations. This is contemplated and within the scope of the claims.

What is claimed is:

1. A sofa sleeper, comprising:

a sofa frame having a back and a pair of opposed arms, the back containing a cavity;

a folding mechanism that folds into and out of the sofa frame, the folding mechanism extendable from a first position to a second position, the folding mechanism including a frame having a rear section rotatable coupled with the sofa frame, a middle section pivotally coupled with the rear section, and a front section pivotally coupled with the middle section; and a mattress assembly supported on the folding mechanism having:

a shell, and an inner support received within the shell, said inner support including an innerspring construction and an air bladder, with the air bladder located at the rear and middle sections;

wherein in the first position, the rear and middle sections of the folding mechanism are located within the cavity and the front section is used as a seating surface and wherein in the second position, the rear, middle, and front sections are used as a sleeping surface.

2. The sofa sleeper of claim 1, wherein the innerspring construction is located at the front section.

3. The sofa sleeper of claim 2, wherein the air bladder is deflated when in the first position and inflated when in the second position.

4. The sofa sleeper of claim 3, further including a pair of rolling supports coupled with the front section of the frame, wherein the rolling supports support the folding mechanism when moved between the first and second positions.

5. The sofa sleeper of claim 4, further including a lock assembly that locks the folding mechanism in the first position.

6. The sofa sleeper of claim 5, wherein the lock assembly includes at least one bracket and at least one latch, the at least one bracket being coupled with the sofa frame and the at least one latch bracket being coupled with the front section of the frame of the folding mechanism, wherein the at least one bracket and the at least one latch cooperate to lock the folding mechanism in the first position.

7. A futon sofa sleeper having a sofa frame including a back and a pair of opposed arms, the back containing a cavity; the futon sofa sleeper comprising:

a folding mechanism that folds into and out of the cavity, the folding mechanism extendable from a first position to a second position, the folding mechanism including a frame having a rear section rotatable coupled with the sofa frame, a middle section pivotally coupled with the rear section, and a front section pivotally coupled with the middle section;

a mattress assembly supported on the folding mechanism having:

a shell, and an inner support received within the shell, the inner support including at least first and second compartments, said first compartment having an innerspring construction and said second compartment having an air bladder;

a pair of rolling supports coupled with the front section of the frame; and a lock assembly that locks the folding mechanism in the first position;

wherein the first position, the rear and middle sections of the folding mechanism are located within the cavity and the front section is used as a seating surface and wherein the second position, the rear, middle, and front sections are used as a sleeping surface; and wherein the rolling supports support the folding mechanism when moved between the first and second positions.

8. The futon sofa sleeper of claim 7, wherein the lock assembly includes at least one bracket and at least one latch, the at least one bracket being coupled with the sofa frame and the at least one latch bracket being coupled with the front section of the frame of the folding mechanism, wherein the at least one bracket and the at least one latch cooperate to lock the folding mechanism in the first position.

9. The futon sofa sleeper of claim, 8 wherein the air bladder is located at the rear and middle sections.

10. The futon sofa sleeper of claim 9, wherein the innerspring construction is located at the front section.

11. The futon sofa sleeper of claim 10, wherein the air bladder is deflated when received within the cavity and inflated when used as a sleeping surface.

12. The futon sofa sleeper of claim 7, wherein the shell includes a lower panel, a sidewall coupled to an edge of the lower panel and extending upwardly therefrom, and a top cover removably coupled to the sidewall, the top cover, lower panel, and sidewall forming a cavity for receipt of the inner support.

13. A futon sofa sleeper, comprising:

a sofa frame having a back and a pair of opposed arms, the back containing a cavity;

a folding mechanism that folds into and out of the sofa frame, the folding mechanism extendable from a first position to a second position, the folding mechanism including a frame having a rear section rotatably coupled with the sofa frame, a middle section pivotally coupled with the rear section, and a front section pivotally coupled with the middle section; and a mattress assembly supported on the folding mechanism having:

a shell; and an inner support received within the shell, the inner support including at least first and second compartments, said first compartment having an innerspring construction and said second compartment having an air bladder, the air bladder being located at the rear and middle sections of the folding mechanism and the innerspring construction being located at the front section wherein the first position, the rear and middle sections of the folding mechanism are located within the cavity, the air bladder is deflated, and the front section is used as a seating surface, and wherein the second position, the air bladder is inflated and the rear, middle, and front sections are used as a sleeping surface.

14. The futon sofa sleeper of claim 13, further including a pair of rolling supports coupled with the front section of the frame, wherein the rolling supports support the folding mechanism when moved between the first and second positions.

15. The futon sofa sleeper of claim 13, further including a lock assembly that locks the folding mechanism in the first position.

16. The futon sofa sleeper of claim 15, wherein the lock assembly includes at least one bracket and at least one latch, the at least one bracket being coupled with the sofa frame and the at least one latch bracket being coupled with the front section of the frame of the folding mechanism, wherein the at least one bracket and the at least one latch cooperate to lock the folding mechanism in the first position.

17. The futon sofa sleeper of claim 13, wherein the shell includes an inner panel, a sidewall coupled to an edge of the inner panel and extending upwardly therefrom, and a top cover removably coupled to the sidewall, the top cover, inner panel, and sidewall forming a cavity for receipt of the inner support.

* * * * *